United States Patent [19]

Nikolich

[11] 4,403,722

[45] Sep. 13, 1983

[54] COMBUSTION GAS POWERED FASTENER DRIVING TOOL

[75] Inventor: Milovan Nikolich, Chicago, Ill.

[73] Assignee: Signode Corporation, Glenview, Ill.

[21] Appl. No.: 227,194

[22] Filed: Jan. 22, 1981

[51] Int. Cl.[3] ..... B25C 1/04

[52] U.S. Cl. ..... 227/8; 227/10

[58] Field of Search ..... 227/8, 9, 10, 11

[56] References Cited

U.S. PATENT DOCUMENTS

| | | | |
|---|---|---|---|
| 3,042,008 | 7/1962 | Liesse | 227/9 |
| 3,858,781 | 1/1975 | Obergfell et al. | 227/8 |
| 3,967,771 | 7/1976 | Smith | 227/10 |
| 4,260,092 | 4/1981 | Austin | 227/8 |
| 4,331,277 | 5/1982 | Green | 227/8 X |

FOREIGN PATENT DOCUMENTS

| | | | |
|---|---|---|---|
| 2552106 | 5/1976 | Fed. Rep. of Germany | 227/9 |
| 52-3772 | 1/1977 | Japan | 227/9 |
| 53-34179 | 3/1978 | Japan | 227/9 |
| 53-115980 | 10/1978 | Japan | 227/9 |
| 53-115981 | 10/1978 | Japan | 227/9 |

*Primary Examiner*—Willie G. Abercrombie

*Attorney, Agent, or Firm*—Dressler, Goldsmith, Shore, Sutker & Milnamow, Ltd.

[57] ABSTRACT

A fastener applying tool is disclosed, powered by the gases produced from internal combustion of a fuel and air mixture. A piston connected to a fastener driver is slidably mounted within a cylinder to move reciprocally downwardly and upwardly through a driving and a return stroke. A combustion chamber is formed at the upper end of the cylinder. A compression chamber is formed at the lower end of the cylinder. A spark plug powered by a piezo-electric firing device, is located within the combustion chamber. The combustion chamber features a set of fan blades driven by an electric motor which is continuously in operation when the tool is in use. A main valve mechanism actuated by a set of lifting rods which are moved upwardly and downwardly when the tool is moved toward and away from the workpiece, is used to control the flow of fresh air through the combustion chamber. When the combustion chamber is isolated from the atmosphere and the fuel and air are thoroughly mixed, the spark plug is fired to explode the fuel and air mixture and force the piston through its driving stroke. The rapid discharge of combustion gases at the end of the driving stroke produces a thermal vacuum within the combustion chamber. Additional air supplied to the lower face of the piston from the atmosphere forces the piston through its return stroke.

29 Claims, 16 Drawing Figures

66
98
99
100
25
65
64
97
120c
57
60
92
39
61
62
123
63
202
4
106
4
59
110
37a
22
49
51
107
10
37
24
21
108a
200
67
12A
58
104a
37b
34
31
103
11
102
38
17
78
75
120a
32
28
82
81
15
36
35
114a
84
83
3
3
112b
114b
80
42c
77
42a
89
85
12
90
14
23
30
79
86
54
76
210
68
87
115
88
16
55
42b
95
120b
19
69
13
26
70
71
56
93
91
29
94
5
72
5
44c
96
50
27d
27a
46
45
43
44b
53
20
48

18
52

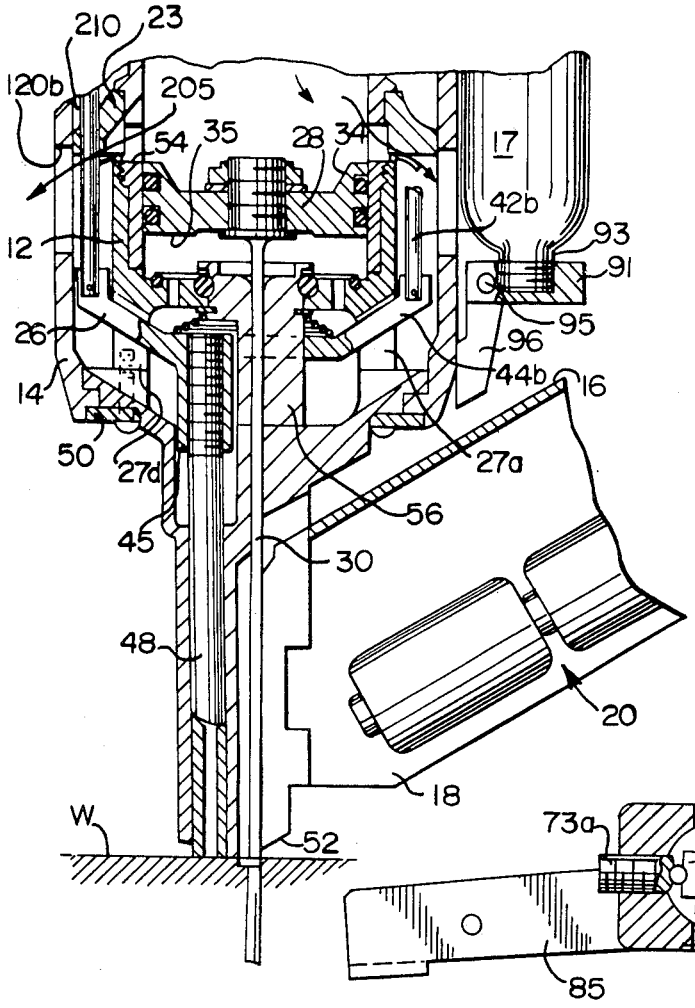
FIG. 6
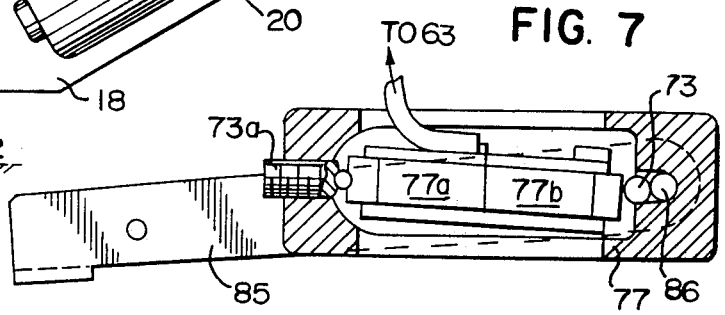
FIG. 7
FIG. 8
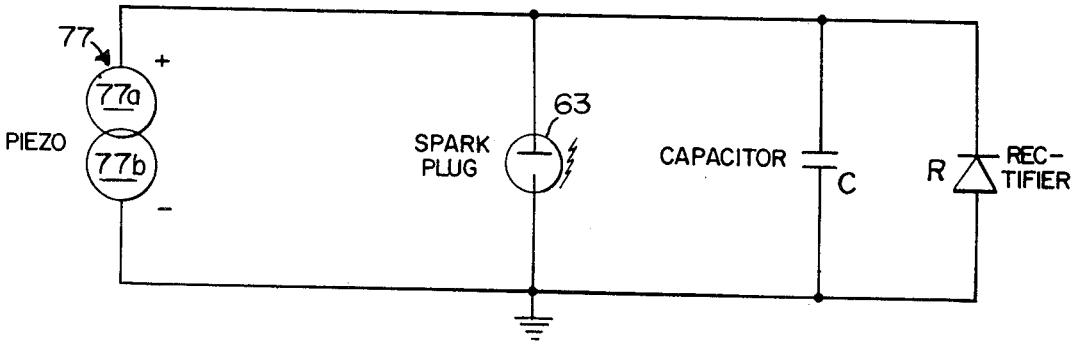

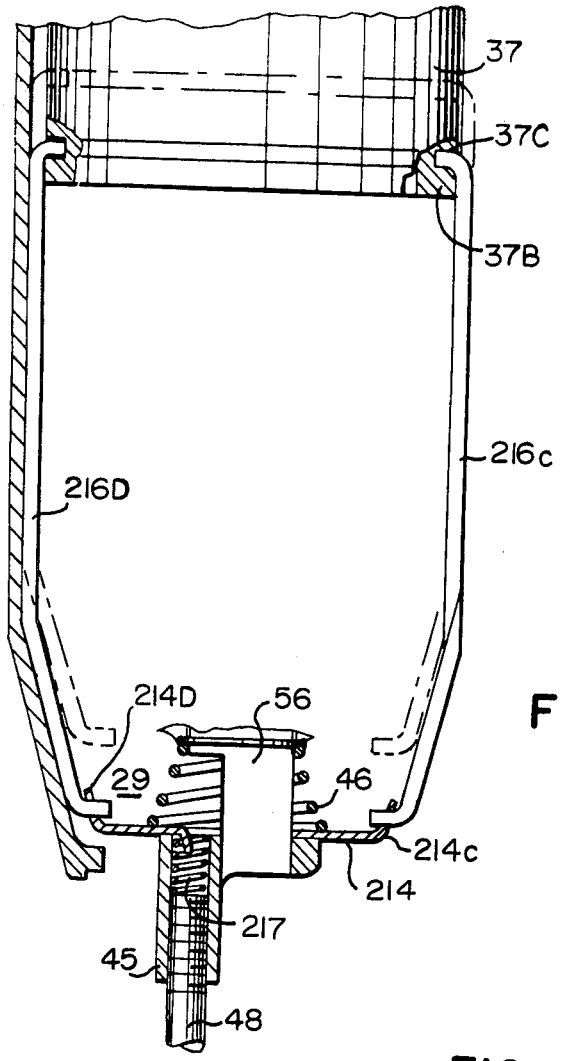
FIG. 10
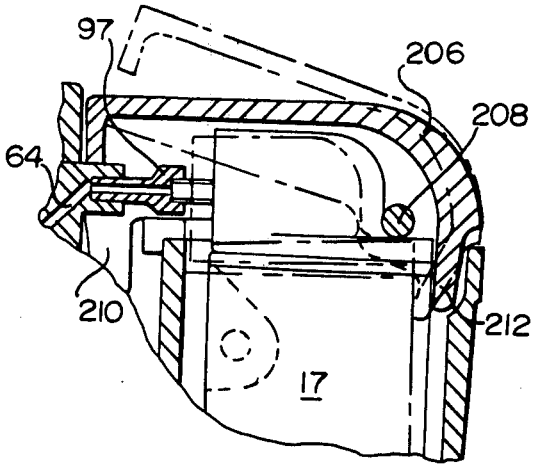
FIG. 12
FIG. 11
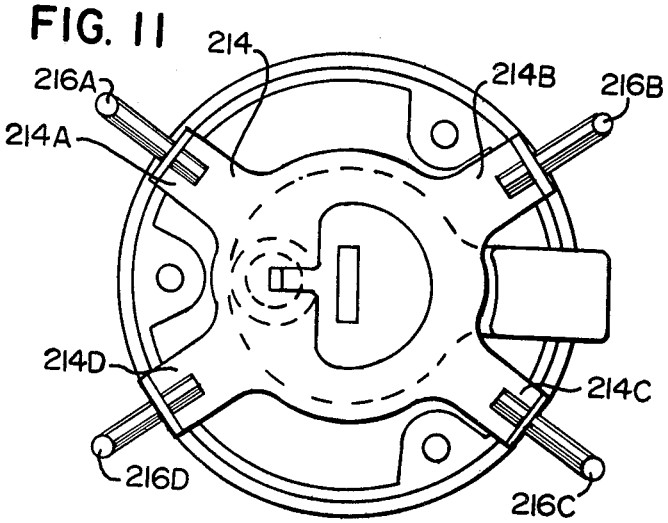

COMBUSTION GAS POWERED FASTENER DRIVING TOOL

TECHNICAL FIELD

This invention relates generally to fastener applying tools of the type used to drive staples, nails and the like into a workpiece. In particular, it is concerned with a fastener applying tool powered by the pressure produced by the combustion of a fuel and air mixture and to those tools which are portable or self-contained and which do not rely on compressed air or electricity to supply the power heretofore necessary to drive large fasteners.

BACKGROUND OF THE INVENTION

Pneumatically driven fastener driving tools are well known to those skilled in the art. One excellent example is described by A. Langas in U.S. Pat. No. 3,106,135 which is assigned to the assignee of the present invention. Another example is U.S. Pat. No. 3,815,475 by Howard and Wilson (also assigned to the assignee of the present invention). These tools have been well received by the industry and perform quite satisfactory. However, they have one basic shortcoming. Pneumatic tools must be provided with a continuous source of pressurized air or gas of a high order of magnitude to drive for example a 3½ inch long nail. This is usually accomplished by a flexible hose joining the tool to a tank filled with pressurized gas or to an air compressor.

Such tools when used in a shop or a relatively restricted area present little inconvenience or burden on the user of the tool. However, when the tools are used "in the field," on construction sites and in remote areas, tools requiring an auxiliary power source become a burden and an inconvenience in addition to the large initial expense required for the investment of such equipment.

Fastener applying tools can be made portable by providing a self-contained source of power. However, if the energy required to operate the tool is high or if the tool must be operated rapidly or for a relatively long period of time, the power source used to operate the tool becomes limiting. None of the available portable tools that can drive large fasteners are capable of high speed operation for an extended period at an economically acceptable rate. Electric batteries, as such, are relatively bulky, high in weight, and do not provide a uniform source of power over a long period of time. A chemical source of power in the form of explosive pellets or shells can be used. However, the operating cost per unit fastener is quite high. In addition, those tools cannot be operated for a relatively long period of time without having the supply of shells or blanks refilled. The only form of self-contained power that would meet the power, speed and portability requirements is the efficient utilization of the power produced by the combustion of a fuel and air mixture within a confined space. U.S. Pat. No. 3,012,549 to Bard et al. and U.S. Pat. No. 4,200,213 to Liesse are examples of portable tools using internal combustion principles.

An examination of these earlier patents indicates a number of shortcomings which, if eliminated, would lead to greater acceptance by the industry. For the most part they have been relatively complicated, large, heavy machines which are awkward to use or manipulate. Some have required a separate tank to provide fuel for combustion. Still others employ timing mechanisms and pressure regulators which can easily come out of adjustment or be damaged during high volume, rapid rate work applications. Some of these earlier tools have required the user to manipulate more than one control lever or switch to cycle the tool. Moreover, the initial cost of the tool has been far in excess of a modern pneumatically powered fastener applying tool. In other words, an efficient, easy to operate, rugged, lightweight, low cost, truly portable fastener applying tool powered by the pressurized gas produced during the internal combustion of a fuel and air mixture is not currently available.

SUMMARY OF THE INVENTION

The present invention relates to a fastener driving tool powered by the gases produced from the combustion of a fuel and air mixture within a confined space. The available power is capable of driving fasteners at a rapid rate in a truly portable tool at an economic basis that up to the present time has only been available with tools requiring auxiliary sources of pressure such as an air compressor. There are illustrated two embodiments of novel and unique tools of the type under discussion. However, these are but exemplary of the many tools that could employ the inventions disclosed herein. In an application simultaneously filed in the name of the same inventor and having the same assignee as the present application, there are illustrated and covered thereby other types of portable tools that use a number of the concepts employed in the fastener driving tools forming the essence of this application.

A housing provides support for the major components of the tool incorporating numerous inventive concepts. A main cylinder, located within the housing, supports and guides a piston to reciprocate through a driving and a return stroke. The lower end of the cylinder is closed-off by the housing. The piston carries a fastener driver and one or more sealing rings for sealing the interface between the piston and the walls of the main cylinder. A combustion chamber is formed at the upper end of the main cylinder by the inside of the housing, the piston, and a main valve mechanism which controls the flow of air between the atmosphere and the upper end of the main cylinder. In the combustion chamber is located a fan that is started prior to operation of the tool to provide turbulence in the combustion chamber which increases the efficiency of the tool. In the illustrated embodiments the main valve mechanism is controlled by a bottom trip mechanism which when it engages a workpiece the main valve mechanism is moved to form a sealed combustion chamber. In one embodiment trigger mechanism operated in conjunction with the bottom trip mechanism acts to (1) operate a firing mechanism, (2) inject fuel into the combustion chamber where the fuel and air are mixed together, and (3) ignite the mixture to drive the piston through its driving stroke. A check valve mounted on the side walls of the main cylinder is used to vent the air compressed within the main cylinder by the lower face of the piston. This check valve also aids in venting the combustion chamber when the piston has completed its driving stroke. In a second embodiment, actuation of the bottom trip acts to close the combustion chamber as it releases the trigger to permit firing. Closing of the combustion chamber acts to activate the fuel injection system to introduce a metered amount of fuel into the combustion chamber.

The piston is precluded from striking the lower end of the main cylinder and the housing by a bumper formed from the air compressed by the piston at the lower end of the main cylinder. This space is not vented by the side valve means. At the conclusion of the driving action expansion and rapid cooling of the gases within the combustion chamber, aided by the cooling effect of the surrounding cylinder walls, causes the pressure in the combustion chamber above the piston to decrease below atmospheric pressure and the pressure of the air forming the bumper is sufficient to force the piston upwardly. The main valve opens to permit scavenging of the combustion gases from the combustion chamber. A check valve, at the lower end of the main cylinder, admits a continuous supply of air at atmospheric pressure to the lower face of the piston. The piston is moved upwardly through its return stroke until it reaches the top of the cylinder where it is retained in position by friction engagement between the piston and cylinder wall, as well as the friction that exists between the driver blade and the stopper through which it extends.

In addition to the above novel aspects of the unique portable tools disclosed herein there are contained in the tool several other important features. The housing carries a small tank of liquified gas such as methylacetylene-propodiene (MAPP gas) or propane. The tank is provided with a self-contained metering valve for dispensing a prescribed quantity of fuel into the combustion chamber. By using liquified gas, a relatively large amount of fuel can be carried in a small volume to operate the tool. The utilization of such fuel results in a substantial economic saving over compressed air. This enhances its portability. A pair of piezo-electric crystals are used to create the spark within the combustion chamber and ignite the fuel and air mixture. These crystals are virtually everlasting and require no maintenance or adjustment.

In addition, as briefly mentioned before, a relatively foolproof interlocking arrangement is used to control the sequence of steps to fire the piston and to insure its safe operation. It insures that the combustion chamber is isolated from the atmosphere before fuel is injected. It also insures that the fuel and air mixture can be ignited only after they have been thoroughly mixed. Also, it insures that the tool cannot be refired unless the main valve mechanism has been cycled to discharge the combustion products and recharge the combustion chamber with fresh air. What is of particular significance about the interlocking arrangement is that it is brought into action merely by grasping the housing of the tool and positioning the tool against the workpiece at the point where the fastener is to be applied. Thus, safety is insured without interfering with the user of the tool or reducing productivity.

It is also worth reiterating that perhaps the most unique aspect of the tool is the manner in which its efficiency and operation are enhanced by the use of an electric fan whose blades are located within the combustion chamber and acts to provide the highly desirable agitation in the surrounding area. The housing carries the motor and the batteries which supply the power to the motor to drive the fan blades. A "deadman's" switch is used to activate the motor whenever the user grasps the front handle portion of the tool. By creating a differential pressure across the combustion chamber, fresh air is forced into the combustion chamber and any combustion gases remaining at the end of the return stroke are driven away whenever the main valve mechanism is open and the electric fan is running. Once the combustion chamber is isolated from the atmosphere the electric fan insures that the fuel and air are thoroughly mixed before the two are ignited. Tests have shown that the creation of the turbulent condition is particularly important where as in this case where the air in the combustion chamber is not previously compressed. The use of a fan in the combustion chamber substantially increases the rate of energy released from the fuel at the time of combustion. In addition, once the piston has been moved through its driving stroke the fan helps in purging combustion gases out of the main cylinder through the side mounted check valve. The fan also induces rapid cooling of the remaining combustion gases within the combustion chamber and the walls of the internal combustion chamber. This insures that a vacuum is formed at the end of the driving stroke so that atmospheric pressure on the other side of the piston can to be used to assist in moving the piston through its return stroke.

Filed concurrently with this application on Jan. 22, 1981, was an application Ser. No. 227,193 entitled "Portable Gas-Powered Tool With Linear Motor," in the name of the same inventor and assigned to the same assignee. This application is directed to a linear moto that is self-contained and requires no separate starting mechanism. The tool can be used to operate various types of attachments, such as, shearing and cutting devices, marking members, hole piercing devices, etc.

Numerous other advantages and features of the invention will become readily apparent from the following detailed description of the invention and the embodiment described, from the claims, and from the accompanying drawings.

BRIEF DESCRIPTION OF THE DRAWINGS

FIG. 6 is a partial, cross-sectional, side elevational view of the fastener driver tool shown in FIG. 1 illustrating the position of the major components located at the lower end of the barrel section at the end of the driving stroke;

FIG. 7 is an enlarged partial, cross-sectional, side, elevational view of the components forming the ignition mechanism;

FIG. 8 is a schematic diagram illustrating the ignition circuit;

FIG. 10 is a partial cross-sectional, side elevational view illustrating details of the safety trip mechanism used in the tool shown in FIG. 9;

FIG. 11 is a partial, cross-sectional, plan view of the fastener driving tool of FIG. 9 taken along line 11—11;

FIG. 12 is an enlarged cross-sectional view of the cap operation of the fuel injection mechanism of the tool illustrated in FIG. 9;

DETAILED DESCRIPTION

Figure 1:
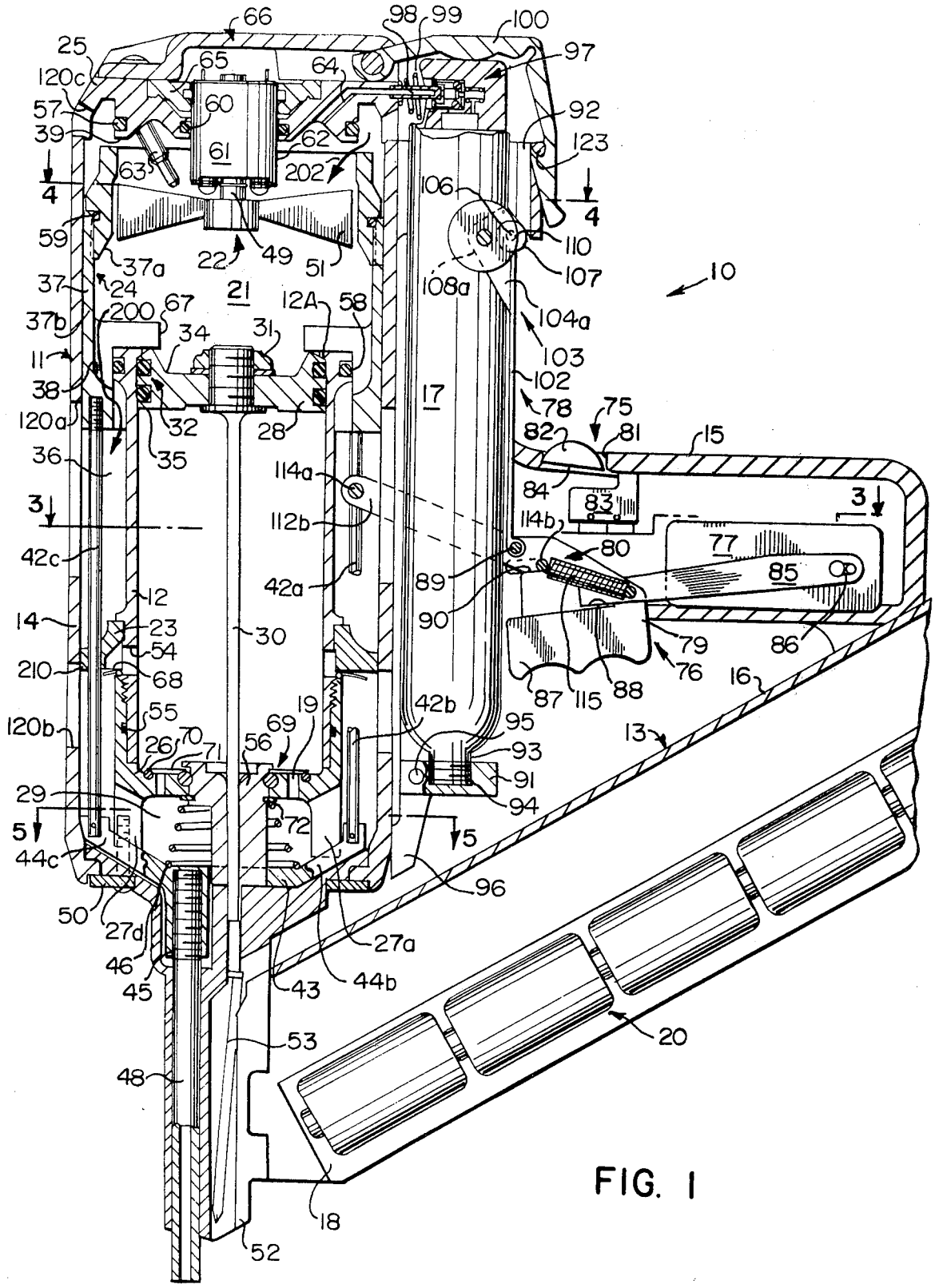
FIG. 1 is a partial, cross-sectional, side, elevational view of a fastener driving tool that is the subject of the invention, and illustrating the relative position of the principal components prior to being placed in operation.

While this invention is susceptible of embodiment in many different forms, there is shown in the drawings and will herein be described in detail two preferred embodiments of the invention with the understanding that the present invention is to be considered an exemplification of the principles of the invention and that it is not intended to limit the invention to the specific embodiments illustrated. The scope of the invention will be pointed out in the claims.

EXTERIOR FEATURES

FIG. 1 illustrates a fastener driving tool 10 the principal components of which are attached to or carried by a generally hollow housing 11. The housing 11 of the tool 10 has three major sections: a barrel section 14; a graspable elongated handle section 15 extending horizontally outwardly from a position generally midway of the barrel section; and a base 13 extending under the barrel section and the handle section. Included in the base 13 is a magazine assembly 16 holding a row of nails disposed transversely to the path of a fastener driver 30. The lower end of the barrel section 14 carries a guide assembly 52 which guides the fastener driver towards the workpiece. The magazine 16 supplies fasteners serially under the fastener driver 30 into the guide assembly 52 to be driven into the workpiece. The base 13 also supports a holder 18 containing a plurality of dry cells which form a power source or battery 20. The purpose and use of the battery will be explained at a later point in this specification.

A fuel tank 17 is mounted between the barrel section 14 and the handle section 15 of the housing 11. The fuel tank 17 is filled with a liquified combustible gas kept under pressure, such as MAPP gas, or propane or butane, which vaporizes when it is discharged to the atmosphere. The fuel tank 17 is supported by a pivoted lower bracket 91 and a fixed, generally U-shaped upper bracket 92. The lower end of the fuel tank 17 defines a boss 93. The boss fits within a complementary opening 94 within the lower bracket 91. A pivot pin 95 pivotally joins the lower bracket 91 with a fixed arm 96 at the lower end of the barrel section 14 of the housing 11. The upper end of the fuel tank 17 carries a valve assembly 97 (to be hereafter described in detail) for metering fuel out of the tank. A flexible plastic cover 100, pivotally joined to the top of the cap or cover 66 at one of its ends and to a notch 123 in the upper bracket 92 at its other end, protects the valve assembly 97. The cover 100 is opened when the fuel tank 17 must be replaced. The cover 100 also provides a downward force which snugly holds the lower end of the fuel tank within the lower bracket 91. At this point it should be noted that the upper bracket 92 has an inside dimension greater than the outside diameter of the fuel tank 17. In particular, this dimension is selected such that if the upper end of the fuel tank is forced towards the upper end of the barrel section 14 of the housing 11, the valve assembly 97 will be actuated to dispense a metered quantity of fuel. The manner in which this is accomplished will be explained after the interior components of the tool have been described.

BARREL SECTION

At the interior of the lower end of the barrel section 14 of the housing 11, there is located an open ended cylinder 12. This cylinder will hereafter be referred to as the "main cylinder." The diameter of the main cylinder 12 relative to the diameter of the barrel section 14 of the housing 11 is such that an open generally annular zone or region 36 is formed (See FIG. 3). The barrel section 14 of the housing 11 is generally hollow and is provided with a number of peripheral openings or slots 120*a*, 120*b* and 120*c* (See FIG. 3). This allows air to pass freely around the exterior of the main cylinder 12.

The driving piston 28 is mounted within the main cylinder. The piston carries the upper end of the fastener driver 30. The upper end of the barrel section 15 of the housing 11 carries an electrically powered fan 22 and a main valve mechanism 24 which controls the flow of air between the tool and atmosphere. For convenience, the upper end of the barrel section of the housing which carries the electric fan 22 will be referred to as the cylinder head 25. The main valve mechanism includes an upper or second cylinder 37 which together with the cylinder head 25, the main cylinder 12 and the piston 28 forms a chamber 21 which can be isolated from the atmosphere. This chamber is suitable for the combustion of a mixture of air and fuel and will be referred to hereafter as the "combustion chamber." The electric fan includes a set of blades 51 which are joined to the output shaft 49 of an electric motor 61.

Now that the major components in the barrel section have been located, these components will be described in greater detail.

The main cylinder 12 in which the piston 28 is located is open at both ends. A cup-shaped support casting 26 attached to the lower end of the barrel section 14 of the housing 11 seals off the lower open end of the main cylinder 12. The support casting 26 is attached to the lower end of the barrel section 14 of the housing 11 by four legs 27*a*, 27*b*, 27*c* and 27*d* (See FIG. 5). A hollow cavity 29 is formed between the outside of the support casting 26 and the upper end of the guide assembly 52. A ring-shaped casting 23 is used to buttress the side walls of main cylinder 12 against the interior of the barrel section 14 of the housing. A plurality of ports 54 piercing the side walls of the main cylinder 12 are located below the ring shaped casting 23. An O-ring 55 seals the interface between the outside wall of the main cylinder 12 and the inside wall of the support casting 26. A seal 56 is used to plug the center of the support casting 26. The seal 56 is preferably made of a plastic material such that it seals the inside of the main cylinder 12 from the outside of the support casting 26. Finally, the base or bottom of the support casting 26 is provided with a plurality of axially extending ports 19. These ports interconnect the inside of the main cylinder 12 with the lower cavity 29 at the bottom of the barrel section 14.

The piston 28 is slidably mounted within the main cylinder 12 such that it is free to move reciprocatingly between the upper end (FIG. 1) and the lower end (FIG. 6) of the main cylinder. The downward and upward movement of the piston defines the driving and the return strokes of the piston, respectfully. The piston 28 carries a fastener driver 30 and a sealing means 32. The fastener driver 30 is joined to the piston 28 by a threaded fitting 31. The lower end of the fastener driver 30 fits within the guide assembly 52 at the lower end of the barrel section 14 of the housing 11. The guide assembly 52 is configured to pass individual fasteners 53 discharged by the magazine 16 in such a manner that when the piston 28 is driven through its driving stroke, a fastener is driven into the workpiece W (See FIG. 2).

As illustrated in the drawings, the sealing means 32 is formed from a plurality of O-rings disposed between the outside periphery of the piston 28 and the inside side walls of the main cylinder 12. The O-rings are sized so that the frictional force between the piston 28 and the inside side walls of the main cylinder 12 is sufficiently great that, in the absence of a differential pressure across the upper face 34 and the lower face 35 of the piston, the piston will remain fixed in place relative to the interior side walls of the main cylinder. It is to be noted that the cylinder 12 defines an overhanging lip 12A which determines the upward movement of piston 23.

A second cylinder 37 constituting the main valve means is located between the upper end of the main cylinder 12 and the cylinder head 25. The second cylinder 37 is formed from a threadably joined upper part **37*a* and lower part 37*b*. The second cylinder 37 is slidably disposed within the upper end of the barrel section 14 of the housing 11 so that it is free to move between a raised position (See FIG. 2) and a lowered position (See FIG. 1). As illustrated in FIG. 1, the second cylinder 37 cooperates with the upper end of the main cylinder 12 to form an opening 38 (hereafter referred to as the "lower opening") between the interior of the two cylinders and the exterior of the housing 11 (See arrow 200). Similarly, the upper end of the second cylinder 37 cooperates with the cylinder head 25 to define a second opening 39 (hereafter referred to as the "upper opening"). The openings 38, 39 interconnect the combustion chamber 21 with the outside air. In the raised position both the upper opening 39 and the lower opening 38 are closed (See FIG. 2). In the lowered position (See FIG. 1) both the upper opening 39 and the lower opening 38** are exposed.

A series of O-rings are used to seal the interface between the second cylinder 37, the main cylinder 12 and a cylinder head 25. Specifically, O-ring 57 cooperates with the upper part **37*a* of the second cylinder to seal the upper opening 39 and O-ring 58, carried by the outside upper edge of the main cylinder 12, cooperates with the lower end of the lower part 37*b* of the second cylinder to seal the lower opening 38. Another O-ring 59 seals the joint between the upper and lower parts 37*a* and 37*b* of the second cylinder 37. Finally, an O-ring 60 is used to seal the interface between the mounting bracket 62 holding the electric fan 22 in the cylinder head 25**.

The lower part **37*b* of the second cylinder 37 is provided with an internal baffle or spider 67, which engages the outside of the upper end of the main cylinder 12 to limit the downward movement of cylinder 37** (See FIG. 1).

When both the lower and upper openings 38 and 39 are unblocked, the combustion chamber 21 is opened to the atmosphere. Moreover, by virtue of the position and configuration of the blades 51 of the electric fan 22 between the two open ends of the second cylinder 37, a differential pressure is formed across the combustion chamber 21 whenever the blades are revolving. This creates turbulence in the chamber 21 and forces air in (arrow 202) through the upper opening 39 and out (arrow 200) the lower opening 38.

The movement of the cylinder 37 is effected by a bottom trip mechanism which functions to permit operation of the tool when it is brought into contact with the workpiece into which a fastener is to be driven. In the instant tool this includes a spring loaded casting that together with a set of lifting rods is used to raise and lower the second cylinder 37. Specifically, a Y-shaped casting 40 (See FIG. 5) is positioned in the cavity 29 between the guide assembly 52 at the bottom of the barrel section 14 and the lower end of the support casting 26. The Y-shaped casting 40 features an open central hub 43 to which are attached three upwardly disposed arms **44*a*, 44*b*, and 44*c*. The lower end of the seal 56 is configured to pass through an opening in the center of the hub 43 of the Y-shaped casting 40. The lower end of the Y-shaped casting 40 defines a cylindrical mount 45 depending downwardly therefrom. A spring 46, positioned between the lower end of the support casting 26 and the upper end of the Y-shaped casting, biases the Y-shaped casting 40** downwardly in an outward direction (See FIG. 1).

Figure 5:
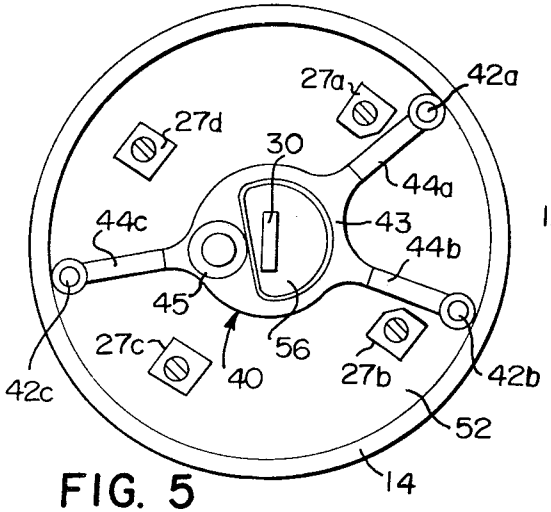
FIG. 5 is a partial, cross-sectional, plan view of the fastener driving tool of FIG. 1 taken along line 5—5.

Three lifting rods **42*a*, 42*b*, and 42*c* join the upwardly extending arms 44*a*, 44*b*, and 44*c* of the Y-shaped casting 40 with the lower end of the second cylinder 37 (See FIG. 5). A series of openings 210 are provided in the ring shaped casting 23 for the lifting rods 42*a*, 42*b*, and 42*c*. A main lifting rod 48 fits within the mount 45 at the lower end of the Y-shaped casting 40. The length of the main lifting rod 48 is selected such that, when the tool is in engagement with the workpiece W (See FIG. 6), the second cylinder 37 is moved from its lowered (See FIG. 1) to its raised position (See FIG. 2). Similarly, when the tool is lifted clear of the workpiece W, the biasing spring 46 moves the second cylinder downwardly to expose the interior of the combustion chamber 21 to the surrounding atmosphere. A ring-like flange 50, removably joined to the lower end of the barrel section 14 of the housing 11, facilitates inspection and repair of the Y-shaped casting 40 and its associated components. Thus, the Y-shaped casting causes the upward motion of the main lifting rod 48 to be transmitted to the second cylinder 37 without unduly restricting or inhibiting the flow of air and gas across the annular zone or region 36 between the outside of the main cylinder 12 and the inside of the barrel section 14 of housing 11**.

The volume or space defined by the lower face 35 of the piston 28, the inside surface of the side walls of the main cylinder 12, and inside surface of the support casting 26 is sealed from the atmosphere with the exception of the ports 54 in the side walls of the main cylinder and the ports 19 at the bottom of the support casting. Flow is controlled through these ports by reed valves or spring loaded flapper check valves 68 and 69. As such, these check valves control the flow of air into and out of the main cylinder 12 from the surrounding atmosphere. For reasons which will become clear after the remaining components in the invention are described, the check valves 68 mounted alongside the walls of the main cylinder 12 will hereafter be referred to as the "exhaust valve means," and the check valves 69 mounted at the bottom of the support casting 26 will hereafter be referred to as the "return valve means."

The return valve means 69 includes an O-ring 70 which cooperates with the leaf or free end of a flapper member 71 to assure that no air at the lower end of the main cylinder 12 leaks into the lower cavity 29. A snap ring 72 holds the seal 56 and the flapper member 71 in place relative to the support casting 26. As will be explained in detail at a later point in this discussion, by insuring that air is trapped at the lower end of the main cylinder 12, the piston 28 is prevented from striking the support casting 26. Effectively, the air compressed by the lower face 35 of the piston 28 forms a "bumper" or air spring. Thus, the volume defined by the lower face 35 of the piston 28, the lower inside side walls of the main cylinder 12 and the inside surface of the support casting 26 define a "compression chamber" (See FIG. 6).

All the major components fitting within the barrel section 14 of the housing 11 have been described with the exception of those components that are joined to the cylinder head 25.

The cylinder head 25 carries the electric fan 22, a spark plug 63 and provides an internal passageway 64 through which fuel is injected into the combustion chamber 21. The mounting bracket 62 for the electric fan 61 is coupled to the cylinder head 25 by a resilient member 65. The resilient member 65 absorbs the shock or force directed at electric fan 22. An upper cap 66 holds the resilient member 65 against the cylinder head 25 and provides an anchoring point for the fuel tank cover 100.

The components located within the handle section 15 of the housing 11 will now be described.

HANDLE SECTION

The handle section or handle 15 of the housing 11 contains the controls used to operate the tool 10. In particular, the handle section 15 contains: a "dead-man's" switch 75; a trigger mechanism 76; a piezo-electric firing circuit 77 which activates the spark plug 63; a portion of a fuel ejecting mechanism 78 which forces fuel into the combustion chamber 21 via the passageway 64 in the cylinder head 25; and a firing circuit interlock mechanism 80 which locks and unlocks the trigger mechanism 76. Each of these components will be individually explained with reference to the figures. Afterwards, the integrated operation of these components will be described in detail.

The dead-mans switch 75 is mounted within an opening 81 at the top of the handle 15. It includes a button 82, an encapsulated electrical contact assembly 83, and an arm 84 which pivotally joins the button to the contact assembly. The electrical contact assembly 83 is joined in series with the battery 20 formed from the dry cells mounted in the holder 18 on the base 13 of the housing 11 and the motor 61 driving the electric fan 22. The arm 84 is biased to the "open" position (i.e., in the open position a pair of contacts within the electrical contact assembly 83 are separated so as to break the electrical circuit). Thus, whenever the tool 10 is grasped by its handle 15, the button 82 is depressed which closes the electrical contacts within the contact assembly 83. This actuates the electric fan 22 whose blades 51 are located in the combustion chamber 21. Since the electrical current is broken whenever the handle 15 of the tool is released, the encapsulated electrical contact assembly 23, arm 84 and button 82 function as a "dead-man's switch." Since the button 82 is depressed whenever the handle 15 of tool 10 is grasped, the electric fan 22 is always started before any other component or device within the tool. The importance of this operational feature will become apparent once the remaining components of the tool are described.

Figure 2:
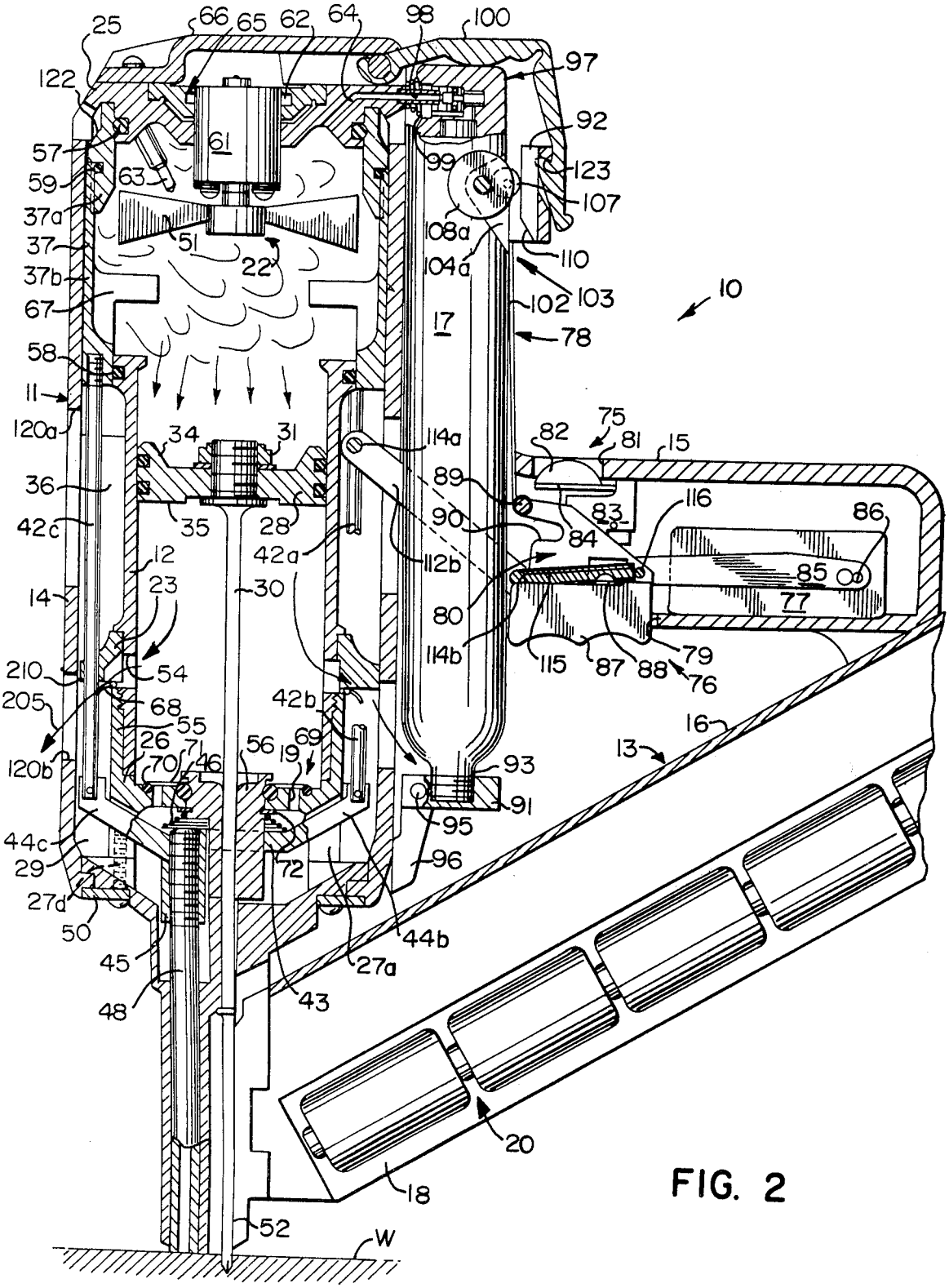
FIG. 2 is a partial, cross-sectional, side, elevational view of the fastener driver tool of FIG. 1 illustrating the position of the principal components shortly after the tool has been fired.
Figure 3:
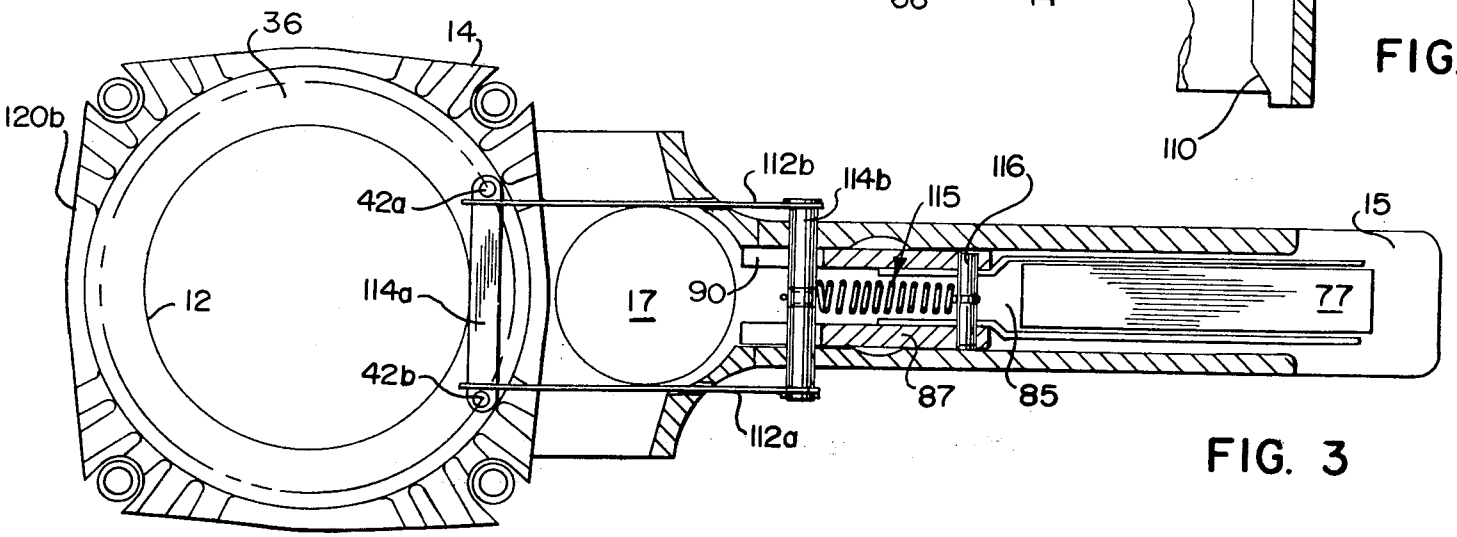
FIG. 3 is a partial, cross-sectional plan view of the fastener driver tool of FIG. 1 as viewed along line 3—3.

The trigger mechanism 76 is mounted at the lower end of the handle 15. It includes: a lever or arm 85 which is pivoted at one end by a pin 86 (FIG. 7) to the firing circuit 77 which is anchored to the inside of the handle 15; and a trigger button 87 joined to the free end of the lever by a machine screw 88 and a pin 116 (FIG. 3). The trigger button 87 fits within an opening 79 at the lower end of the handle 15. The upper end of the trigger button 87 is joined by a pivot pin 89 to the fuel ejecting mechanism 78. The trigger button 87 also defines a generally U-shaped slotted opening 90 positioned between its upper and lower sections. The lever 85 is free to move between a raised position (FIG. 2) and a lowered position (FIG. 1). The purpose of the slotted opening 90 will become apparent after the firing circuit interlock mechanism 80 is described.

Figure 4:
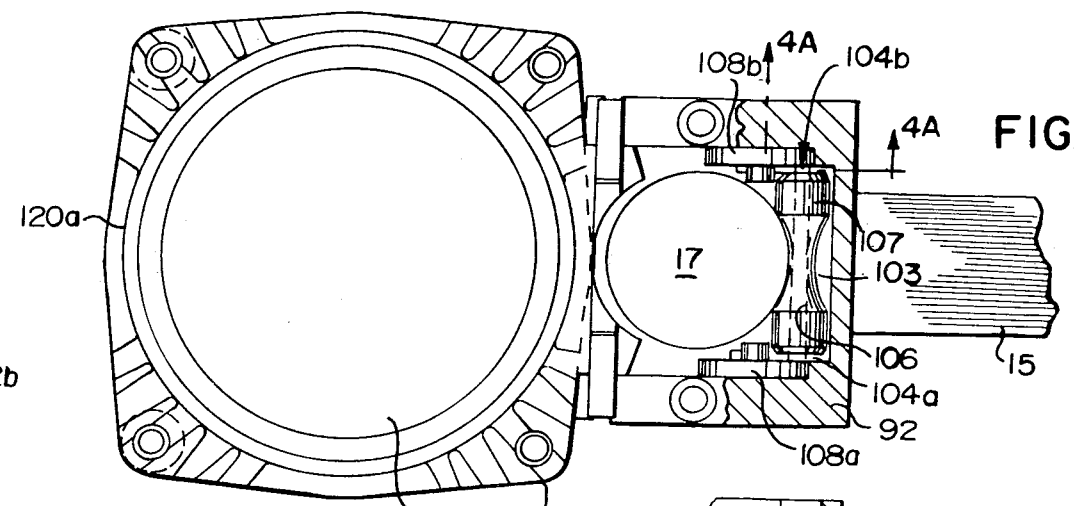
FIG. 4 is a partial, cross-sectional plan view of the fastener driver tool of FIG. 1 taken along line 4—4.
Figure 4A:
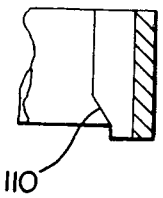
FIG. 4A is a detailed side, elevational view of the camming surface shown in FIG. 4 as viewed along line 4A—4A.

The fuel ejecting mechanism 78 which acts to introduce a prescribed metered amount of fuel into the combustion chamber will now be described. Referring to FIG. 4, a plan view of the U-shaped upper bracket 92 is presented which shows the relationship between the upper end of the fuel tank 17 and the upper end of the barrel section 14 of the housing 11. The valve assembly 97 has an outlet nozzle 98 which is joined to the passageway 64 in the cylinder head 25. A spring 99 biases the valve assembly 97 away from the upper end of the barrel section 14. The fuel ejecting mechanism 78 includes: an actuating linkage 102 and a camming mechanism 103. The actuating linkage 102 joins the upper end of the trigger button 87 with a camming mechanism 103 which is used to overcome the spring 99 and swing the upper end of fuel tank 17 inwardly in response to the movement of trigger mechanism 76. The lower end of the actuating linkage 102 is connected to the trigger button 87 by a pivot pin 89. The upper end of the actuating linkage 102 supports a pair of parallel transverse ears **104*a* and 104*b*. The ears in turn support two parallel wheels 108*a* and 108*b* and a shaft 106. The edges of the two wheels rest against a camming surface 110 defined at the interior of the bight portion of the upper bracket 92 (see detail, FIG. 4A). The shaft 106 supports a roller 107 which bears against the exterior of fuel tank 17. Thus, when the actuating linkage 102 is forced upwardly by the trigger mechanism 76, the wheels 108*a* and 108*b* are driven across the camming surface 110 which moves ears 104*a* and 104*b* upwardly and inwardly towards the barrel section 14 of the housing 11. This, in turn, drives the roller 107 against the fuel tank 17 in opposition to the force of biasing spring 99. Since the fuel tank 17 is free to pivot about the lower bracket 91, the upward movement of the actuating linkage 102 opens the valve assembly 97 which injects a metered quantity of liquid fuel into combustion chamber 21 (See FIG. 2). Once the trigger button 87 is released, the actuating linkage 102 is free to move downwardly. This resets or closes the valve assembly 97. Thus, the trigger mechanism 76 controls the operation of the valve assembly 97 which injects fuel into the combustion chamber 21**.

The fuel injected into the combustion chamber 21 is ignited by a spark plug 63 powered from a piezo-electric firing circuit 77. FIG. 7 illustrates the firing circuit 77. According to the piezo-electric effect, a voltage is produced between opposite sides of certain types of crystals 77*a* and 77*b* when they are struck or compressed. Here, a camming mechanism 73, actuated by the lever 85 and pivot pin 86, is used to force together the two crystals 77*a* and 77*b*. An adjustment screw 73*a* sets the preload to the assembly. A schematic diagram of the electrical circuit between the spark plug 63 and the piezo-electric firing circuit 77 is illustrated in FIG. 8. It includes a capacitor C and a rectifier R. The capacitor C stores energy until the spark discharges, and the rectifier R permits the spark to occur when the trigger is squeezed, but not when the trigger is released. The piezo-electric firing circuit 77 is tripped when the lever 85 is raised upwardly by the trigger mechanism 76. Before the firing circuit 77 can be refired or recycled, the lever 85 must be lowered to cock the cam 73 used to force the two crystals 77*a* and 77*b* together.

The only component that has not been described that is used with the components housed within the handle section 15 of the housing 11 and the barrel section 14 of the housing is the firing circuit interlock mechanism 80. This mechanism precludes firing of the tool until all components are in their proper position. FIG. 3 shows a top plan view of the major components of the firing circuit interlock mechanism 80. It includes a pair of links 112*a* and 112*b* joined together by a pair of connecting pins 114*a* and 114*b* which are connected to trigger mechanism 76 by a tension spring 115 and a pivot pin 116. The two connecting links 112*a* and 112*b* are located on either side of the fuel tank 17. One connecting pin 114*a* (hereinafter called the "lift pin") is mounted between two lifting rods 42*a* and 42*b* which join the second cylinder 37 with the Y-shaped casting 40 (See FIG. 5). The other connecting pin 114*b* (hereinafter called the "lock pin") fits within the slotted opening 90 in the trigger button 87. The pivot pin 116 is carried by and links together the lever 85 operating the firing circuit 77 with the trigger button 87. Thus, the tension spring 115, in the absence of any external force, holds the lock pin 114*b* within the slotted opening 90 in the trigger button 87.

The position of the lift pin 114*a* (on the lifting rods 42*a* and 42*b* relative to the lock pin 114*b*) is selected to prevent the trigger button 87 from being moved upwardly with the combustion chamber 21 open to the atmosphere. FIG. 2 illustrates the arrangement of the various pins and links when the combustion chamber 21 has been isolated from the atmosphere. Thus, when the tool 10 is positioned over the workpiece such that the main lifting rod 48 is forced upwardly, the connecting links 112*a* and 112*b* pull the lock pin 114*b* out of the slotted opening 90 in the trigger button 87. Once the lock pin 114*b* has cleared the trigger button 87, the trigger mechanism 76 can be actuated upwardly by pressing the trigger button 87. This fires the piezo-electric firing circuit 77 and operates the fuel ejecting mechanism 78.

In summary, when the user of the tool 10 grasps the tool about its handle 15, the dead-mans switch 75 is tripped which immediately energizes the electric fan 22. This forces fresh air into the combustion chamber 21. Once the main lifting rod 48 is raised by positioning the tool 10 on the workpiece the trigger mechanism 76 is unlocked. Subsequent upward movement of the trigger button 87 activates the valve assembly 97 which injects fuel into the combustion chamber where it is thoroughly mixed with freshair by the electric fan 22. Soon thereafter the piezo-electric firing circuit 77 is tripped and a spark is produced in the combustion chamber 21 by the spark plug 63 whereupon the fuel and air mixture is ignited.

OPERATION OF TOOL ILLUSTRATED IN FIGS. 1-8

Now that all the major components of the tool have been described in detail the integrated operation of the various components of the tool will be described while highlighting the remarkable manner in which the tool operates.

Referring to FIG. 1, whenever the tool 10 is grasped about its handle 15 the dead-man's switch 75 is tripped which starts the electric fan 22. As long as the tool is held above the workpiece such that the main lifting rod 48 is fully extended, the second cylinder 37 is held in its lowered position by the biasing spring 46. When the second cylinder 37 is in its lowered position the combustion chamber 21 is in communication with the surrounding atmosphere by way of the upper opening 39 and the lower opening 38 and the slots 120*a*, 120*b*, and 120*c* in the barrel section 14 of the housing 11. Since the electric fan 22 is running, a differential pressure is produced across the combustion chamber 21. This forces fresh air in (arrow 202) through the upper opening 39 and out (arrow 200) through the lower opening 38. The rotating fan blades 51 produce a swirling turbulent effect within the combustion chamber 21. Any combustion gases remaining in the combustion chamber 21 due to the previous operation of the tool are thoroughly scavenged and discharged from the combustion chamber by the operation of the electric fan 22.

Once the tool 10 is positioned on the workpiece such that the bottom of the guide assembly 52 is in contact with the workpiece W, the main lifting rod 48 is depressed (See FIG. 2). This overcomes the force of the biasing spring 46 and forces the Y-shaped casting 40 and the associated lifting rods 42*a*, 42*b*, and 42*c* upwardly. This upward movement lifts the second cylinder 37 from its lowered to its raised position. Once the second cylinder 37 is in its raised position the combustion chamber 21 is isolated from the atmosphere.

The upward movement of two of the lifting rods 42*a* and 42*b* also activates the firing circuit interlock mechanism 80. In particular, the upward movement of the lifting rods 42*a* and 42*b* pulls the lock pin 114*b* out of the slotted opening 90 in the trigger button 87. Once the lock pin 114*b* is free from the trigger button 87, the trigger mechanism 76 can be operated.

When the user of the tool 10 forces the trigger button 87 upwardly, the fuel ejecting mechanism 78 is actuated. This forces a metered quantity of fuel into the combustion chamber 21 from the fuel tank 17. In particular, the upward movement of the trigger button 87 operates the valve assembly 97 which forces a fixed metered quantity of fuel into the combustion chamber by way of an internal passageway 64 in the cylinder head 25. Since the blades 51 of the electric fan 22 are continuously rotating, the fuel is thoroughly mixed with the fresh air already in the combustion chamber 21. This insures rapid combustion. Continued upward movement of the tripper button 87 eventually trips the piezo-electric firing circuit 77 which fires the spark plug 63 in the combustion chamber 21.

The rapid expansion of the exploding air and fuel mixture pressurizes the upper face 34 of the piston 28 and drives the fastener driver downwardly where it forces a fastener 53 into the workpiece. In addition, the movement of the piston 28 through its driving stroke compresses the air within the main cylinder 12 bounded by the lower face 35 of the piston and the inside of support casting 26 (See FIG. 2). As the pressure increases below the piston 28, the exhaust valve means 68 on the side walls of the main cylinder 12 pops open. As long as the exhaust valve means 68 is open the pressure cannot build up on the lower face 35 of the piston. Eventually, however, a point is reached where the piston 28 passes beyond the side openings or ports 54 on the side walls of the main cylinder 12 (See FIG. 6). Since the air bounded by the lower face of the piston 28 and the inside of the support casting 26 is now isolated from the atmosphere, the pressure on the lower face 35 of the piston rapdily increases. Effectively, a compression chamber has been formed in the lower end of the main cylinder 12. This functions as a "bumper" which prevents the piston 28 from striking the support casting 26.

Once the pistson 28 has passed the ports 54 on the side walls of the main cylinder 12, the combustion gases are free to flow out of the main cylinder 12 through the exhaust valve means 68 to the atmosphere (arrow 205). Studies on a prototype of the fastener driver tool 10 have shown that the temperature of the gases in the combustion chamber rapidly drops from approximately 2000 degrees F. to 70 degrees F. in about 70 milliseconds due to the expansion of the gases as the piston moves downwardly and the cooling effect of the walls surrounding the expanding gases. This sudden temperature drop produces a thermal vacuum within the combustion chamber 21. Once the pressure within the combustion chamber is below atmospheric, the exhaust valve means 68 shuts off.

As soon as the pressure on the upper face 34 of the piston 28 is less than the pressure on the lower face 35, the piston will be forced upwardly through its return stroke. Initially this upward movement is caused by the expansion of the compressed air within the compression chamber (See FIG. 6). Subsequent movement is caused by the pressure of the atmosphere since the thermal vacuum formed within the combustion chamber 21 is in the order of a few psia. Additional air is supplied to the lower face 35 of the piston 28 through the return valve means 69 which is opened by the atmospheric pressure. The piston 28 will continue upwardly until it engages cylinder lip 12A. The piston will remain suspended or at the upper end of the main cylinder 12 by virtue of the frictional engagement between the sealing means 32 and the cylinder wall plus the force of the seal 56 on the fastener driver 30 (See FIG. 1).

If the tool 10 is then lifted clear of the workpiece the main lifting rod 48 is forced outwardly by its biasing spring 46. Since the electric fan 22 is still in operation, any remaining combustion gases are forced out (arrow 200) of the lower opening 38 and fresh air is drawn in (arrow 202) through the upper opening 39. This prepares the tool 10 for firing another fastener into the workpiece. When the trigger button 87 is released the piezo-electric firing button 87 is reset or cocked for a subsequent firing. When the main lifting rod 48 is driven downwardly by the biasing spring 46, the lock pin **114*b* within the firing circuit interlock mechanism 80 is forced into the slotted opening 90 in the trigger button 87. This prevents subsequent operation of the trigger mechanism 76 until the tool 10** is properly positioned on the workpiece and the combustion chamber is isolated from the atmosphere.

EMBODIMENT ILLUSTRATED IN FIGS. 9–12

The fastener driving tool illustrated in FIGS. 9–12 is similar in many respects to that illustrated in FIGS. 1–8. The portions of the tool in FIG. 9 that are substantially identical with those illustrated in FIG. 1 have been given the same numerals and will only be briefly referred to herein. However, the aspects of the tool in FIGS. 9–12 that differ from those illustrated in FIGS. 1–8 will be dealt with in detail.

Figure 9:
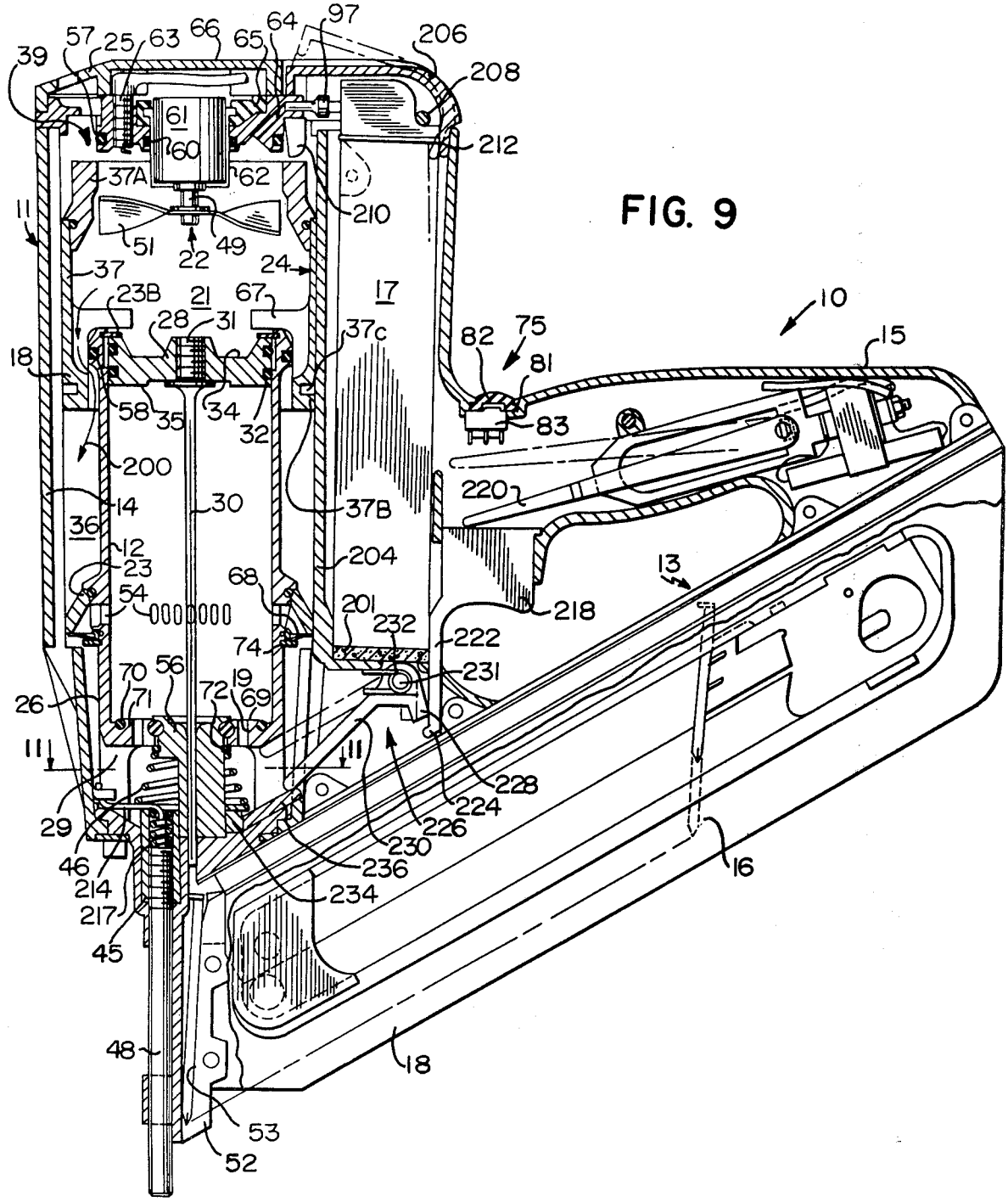
FIG. 9 is a view similar to FIG. 1, but illustrating a second embodiment of a tool embodying the present invention.

The principal components of the second embodiment of the fastener driving tool disclosed in FIG. 9 are very similar to those in FIG. 1 in that the tool in FIG. 9 contains a housing 11 including a barrel section 14, a graspable elongated handle section 15 extending outwardly from a position generally midway of the barrel section, and a base 13 extending under the barrel section and the handle section. Included in the base 13 is a magazine assembly 16 holding a row of nails diposed transversely to the path of the fastener driver 30. Essentially, the barrel section of the tool including the fan, piston assembly, main valve means and a bottom trip safety mechanism are very similar to that disclosed in FIGS. 2–5 except for those differences to be discussed hereinafter. Specifically, the mechanism for positioning the upper cylinder 37 that constitutes a main valve means to control the opening and closing of the combustion chamber 21 is slightly different from that disclosed in FIG. 1. Briefly, upward movement of the lifting rod 48 by bringing the tool into contact with the workpiece acts to move the rod support 214 upwardly against the action of the spring 46. As shown in FIGS. 10 and 11, the rod support 214 is essentially X-shaped and includes four leg portions, 214A, 214B, 214C, and 214D. Connected to each of these leg portions are lifting rods 216A, 216B, 216C and 216D, which as shown in FIG. 10 have their upper ends disposed in the annular slot 37C of cylinder 37. Engagement of lifting rod 48 with the workpiece will raise the rod support 214 and rods 216A-D to move cylinder 37 upwardly and bring the upper portion 37A of cylinder 37 into sealing contact with O-ring 57 and lower portion 37B of cylinder 37 into sealing contact with O-ring 58 to seal off the combustion chamber.

Another difference between the two embodiments is that in the embodiment shown in FIG. 9 upward movement of the cylinder 37 acts to introduce a metered amount of fuel into the combustion chamber. This action takes place through the action of the cylinder 37 engaging depending arm 210 of the cap 206. Upward movement of the cap 206 acts to pivot the cap 206 about the pivot pin 208, with the result that valve assembly 97 is moved inwardly to admit a metered amount of fuel into the passageway 64 leading into the combustion chamber 21. Counterclockwise movement of the fuel tank 17 is permitted by the resilient pad 201 upon which the tank 17 rests within the U-shaped support 204.

Other differences from the tool of FIG. 1 located in the barrel portion of the tool include the provision of a snap ring 238 located in the top of the cylinder 12 which limits the upward movement of the piston 28, and a second snap ring 74 located within a slot in the bottom portion of the cylinder 12 which serves as a backup support for the valve 68. In addition, there is provided a spring 217 within the cylinder mount 45, which spring is disposed between the rod support 214 and the lifting rod 48 to insure that the lifting rod will always be moved to its outward position when the tool is moved away from the workpiece, irrespective of whether or not the cylinder 37 has been moved to its downward position by the action of the spring 46.

Another difference between the two embodiments is the bottom safety mechanism disclosed in FIG. 9, which prevents movement of the trigger to bring about firing of the tool until the tool engages a workpiece. The tool of FIG. 9 employs a safety latch mechanism 226, which when the tool is out of engagement with the workpiece is positioned so that the latch arm 228 thereof prevents trigger actuating movement of the trigger 218 by virtue of engagement between the latch arm 228 and the flange 224 that extends outwardly from the trigger leg 222 of the trigger 218. The trigger latch 226 is maintained in the position shown by the action of a torsion spring 232 which is located about the pin 231 whereby the safety latch is connected to the tool housing 11. It is seen that the latch 226 is moved out of engagement with the trigger 218 by the upward movement of the lifting rod 48. The lifting rod 48 connected to the ring 234 through the cylindrical mount 45. The ring 234 has an arm 236 that is normally in engagement with the latch arm 230. Thus, when the lift rod 48 moves upwardly, the ring arm 236 pivots the safety latch 226 in a clockwise direction to move the latch arm 228 out of engagement with flange 224. The trigger 218 is now free to move and its upward movement moves the lever 220, which actuates the piezo-electric circuit to send a charge to spark plug 63 and ignite the fuel and air mixture contained in the combustion chamber.

OPERATION OF TOOL ILLUSTRATED IN FIGS. 9–12

Grasping of the handle 15 in the forward position by the user will trip the deadman switch 75 and start the electric fan 22. When the tool is put into contact with a workpiece, the main lifting rod 48 is moved upwardly against the spring 46 to seal off the combustion chamber 21. As in the case with the tool illustrated in FIG. 1, the actuation of the electric fan before the upward movement of the cylinder 37 results in there being swirling, turbulent air in the combustion chamber.

The upward movement of the cylinder 37, in addition to sealing off the combustion chamber, results in introducing a metered amount of fuel into the combustion chamber through passageway 64. This occurs as a result of the cylinder 37 engaging the depending arm 210 of the cap 206, which acts to swing the cap 206 upwardly and move the tank 17 in a counterclockwise direction to actuate the fuel valve assembly 97 inwardly to dispense a metered amount of fuel into the chamber 21.

The upward movement of the lifting rod moves the safety latch 226 in a clockwise direction to disengage the latch from the trigger mechanism to permit the trigger 218 to move upwardly. Upward movement of the trigger 218 results in actuating the piezo-electric firing circuit which fires the spark plug 63 in the combustion chamber 21. The piston is then driven to drive a nail into a workpiece. The return action of the piston and the scavenging of the combustion chamber is identical to that which occurs in the tool of FIG. 1, and further repetition of that opertion is not believed necessary.

Tests have shown that approximately 5000 fasteners can be driven with a fuel tank containing a half a pound of liquified Mapp gas. This amounts to an operating cost of approximately five cents per thousand fasteners. This is about half the cost of operating a pneumatic powered tool powered by a gasoline driven air compressor. Although the efficiency of the complete cycle is about 5%, the force provided by the combustion of the fuel and air mixture is adequate enough to drive a 3-½ inch nail with 1000 inch pounds of energy while producing a peak pressure of approximately 90 psia.

As previously mentioned, these surprising results are due in part to the novel use of an electric fan whose blades are located within the combustion chamber and which is run throughout the firing cycle. The fan not only creates turbulence to obtain adequate mixing of the fuel and air mixture, but also aids in discharging the combustion gases. In an illustrated embodiment a DC electric motor operating at a speed of approximately 6000 rpm was used. The combustion chamber was 21 cubic inches and the volume below the piston was 23 cubic inches. The driving stroke was approximately 5 inches and the fan blades were approximately 2 ½ inches in diameter.

Fuel Supply For Embodiments of FIGS. 1–8 and FIGS. 9–12

Figure 13:
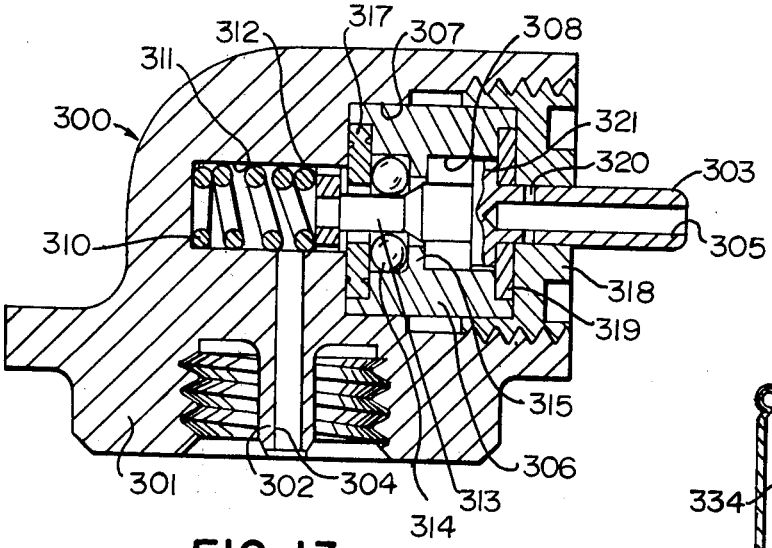
FIG. 13 is an enlarged cross-sectional view of the fuel metering valve of the present invention.
Figure 14:
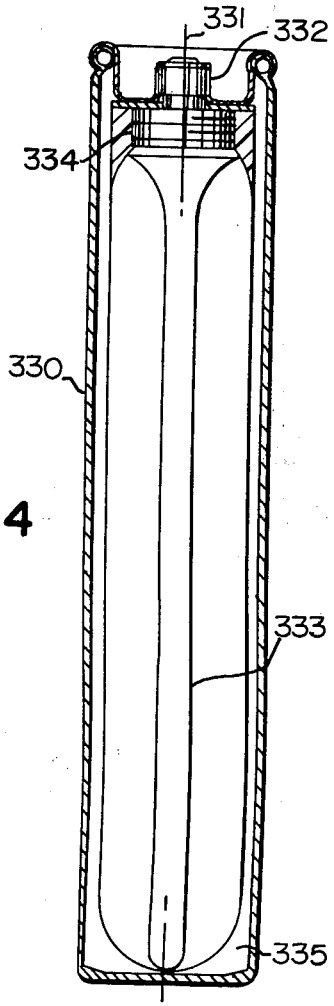
FIG. 14 is an enlarged cross-sectional view of a source of fuel used with the present invention.
Figure 15:
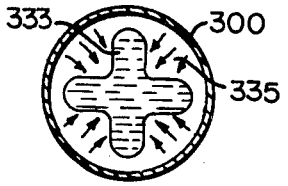
FIG. 15 is a cross-sectional view taken along line 15—15 of FIG. 14.

A preferred form of metering valve is shown generally at 300 in FIG. 13. Valve 300 includes a valve body 301 having a fuel inlet stem 202, and a fuel outlet stem 303 having passages 304 and 305, respectively. Valve body 301 includes a bushing 306 seated within a generally cylindrical cavity 307, and bushing 306 is provided with a cylindrical cavity 308 which defines a metering chamber.

A coil spring 310 is mounted in a cylindrical cavity 311 in valve body 301 and bears against a spring seat 312 carried at the reduced diameter end 313 of stem 303. An O-ring 314 is disposed around stem portion 313, and is loosely received between a flange 315 on bushing 306 and a gasket 317. A plug 318 is threadably received within valve body 301 and bears against a flexible gasket 319. Plug 318 supports stem 303 for axial movement with respect thereto. Radially extending outlet openings 320 are provided in stem 303 for discharging liquid fuel in atomized form into the passage 64 leading to the combustion chamber.

The metered charge of liquid fuel within metering chamber 308 is placed in fluid communication with passage 305 when stem 303 is moved inwardly, since openings 320 are disposed to the left of gasket 319, and the liquified gaseous fuel expands into the combustion chamber through passages 305 and 64. When the stem 303 is shifted to the right, as viewed in FIG. 13, under the influence of spring 310, the inclined portion of stem 303 moves away from O-ring 314 and a fresh charge of liquid fuel passes into chamber 308 between stem portion 313 and O-ring 314.

Metering valve body 301 is associated with liquified gas container 330 by the insertion of inlet stem 302 within an outlet passage 331 at the upper end of container 330. The outlet passage 331 is associated with a conventional valve 332, forming no part of the present invention. The container 330 is preferably formed of metal to provide appropriate bursting strength, and supported within container 330 is a bag 333 of generally cruciform shape which has a threaded upper end 334 threadably associated with valve 332. Bag 333 is collapsible, and contains therewithin a given volume of liquified gas. A suitable propellant 335, such as propane, is provided between the bag 333 and the inner wall of container 330 for applying pressure to bag 333 for expelling liquid fuel outwardly of valve 332, and into the metering valve through inlet passage 304.

In the most preferred embodiments of the invention a suitable lubricating medium is associated with, and dispersed within the liquid fuel in bag 333. The lubricating medium may take the form of a lubricating oil, which is mixed as a minor percent with the liquid gas in bag 333. It has been found that such a lubricating medium not only does not significantly detract from ignition of the liquid fuel in the combustion chamber or from flame propagation therewithin, but also reduces wear on the moving parts thus prolonging the useful life of the metering valve and other moving parts of the tool.

It also should be appreciated from the drawings and the description just presented that the components of the tool are ruggedly constructed and not likely to result in reliability problems. Moreover, because of the straight-forward approach taken in integrating the components of the tool, manufacturing costs can be kept low and maintenance is relatively easy. The overall size and weight of the tool is also comparable to conventionally powered fastener driver tools. A "cordless" fastener driving tool which has low operating costs and which offers high reliability is a product which will readily be accepted by the marketplace.

Thus, it will be appreciated from the foregoing description that the present invention provides an improved fastener driving tool having many advantages and improvements. While the invention has been described in conjunction with a specific embodiment, it is evident that many alternatives, modifications and variations will be apparent to those skilled in the art. Accordingly, it is intended to cover by the following claims all such alternatives, modifications, and variations that are within the spirit and scope of the invention.

What is claimed is:

1. A portable fastener driving tool comprising a housing, a cylinder in said housing, a piston in said cylinder and movable through a driving stroke from a driving to a driven position, a driver attached to said piston, a magazine for supplying fasteners into position to be driven by said driver, a combustion chamber formed within said housing and having said piston as one wall thereof, a fan in said combustion chamber and controls therefor to operate same to cause turbulence in said chamber, main valve means controlling the flow of air into said combustion chamber and the exhausting of the gases of combustion from said combustion chamber, means for providing fuel into said combustion chamber and igniting same for driving said piston from said driving position to said drive position to drive a fastener, and means for returning the piston to the driving position after a fastener has been driven.

2. A tool as set forth in claim 1, in which the housing defines inlet and outlet ports and the main valve means includes a slidable cylinder that closes off said inlet and outlet ports to seal said combustion chamber during combustion and open said ports to permit scavenging of said combustion chamber and return of said piston after the driving stroke of said piston.

3. A tool as set forth in claim 2, in which the tool includes a bottom trip mechanism secured to said slidable cylinder whereby the combustion chamber is not closed off until the tool is in position to drive a fastener into a workpiece.

4. A tool as set forth in claim 3, in which the means for providing fuel into said combustion chamber includes a fuel supply and a metered flow control valve for introducing a predetermined quantity of fuel into said combustion chamber, and the igniting means includes a spark plug in said combustion chamber.

5. A tool as set forth in claim 1, which includes a slidable cylinder that is part of said valve means, means for moving the sliding cylinder between positions to open and close said combustion chamber, and wherein the means for providing fuel into said combustion chamber includes means for introducing a metered quantity of fuel into the combustion chamber which is operated in response to the movement of said slidable cylinder.

6. A tool as set forth in claim 5, in which the means for providing fuel into said combustion chamber includes a fuel supply mounted in said housing, a metered flow valve means connected to said fuel supply, and wherein the means for introducing a metered quantity includes a pivotably mounted cap member surrounding at least part of said fuel supply means and constructed and arranged to move same, said cap defining a depending portion adapted to be contacted by said sliding cylinder to move said fuel supply and operate said metered flow valve means to introduce a metered amount of fuel into the combustion chamber when the sliding cylinder is moved to a position closing said combustion chamber.

7. A tool as set forth in claim 4, including a trigger control mechanism for operating said flow control valve and for supplying a high voltage to said spark plug to ignite the fuel in said combustion chamber.

8. A tool as set forth in claims 1 or 5, including a trigger interlock mechanism for preventing the introduction of fuel into said combustion chamber and igniting of same until the combustion chamber is sealed off from the atmospheric air.

9. A tool as set forth in claim 8, in which the trigger interlock mechanism is interconnected to a bottom trip mechanism, whereby until the bottom trip mechanism is engaged the trigger cannot be actuated.

10. A tool as set forth in claim 3, including latch means responsive to the operation of said bottom trip mechanism, and trigger means for controlling the firing of said tool that is retained in an inoperative position by said latch means whereby when the bottom trip mechanism is actuated the latch means is moved into position to permit operation of said trigger means.

11. A tool as set forth in claim 3, in which the bottom trip mechanism includes a spring biased member that extends beyond the outlet of the fastener to be driven and includes a plurality of rod members secured to said slidable cylinder, whereby upon engagement of the spring biased member with the workpiece the slidable cylinder is moved into sealing engagement with the housing to close off the combustion chamber.

12. A tool as set forth in claim 9, in which the bottom trip mechanism includes a plurality of rods disposed adjacent the main cylinder, and in which the trigger interlock mechanism is normally spring biased into an inoperative position and is moved into an operative position through an interconnection to said rods as said rods are moved by the engagement of said bottom trip mechanism with the workpiece.

13. A tool as set forth in claim 5, including a bottom trip mechanism connected to said slidable cylinder for effecting movement of the slidable cylinder, said bottom trip mechanism includes a plurality of rods disposed adjacent to the main cylinder, and spring means in said housing for retaining the bottom trip mechanism in its extended position whereby the slidable cylinder is normally in the open position.

14. A tool as set forth in claim 13, in which the bottom trip mechanism includes a lifting rod that is spring-biased outwardly whereby when the tool is removed from a workpiece the lifting rod will be moved to an outward position independent of the position of said slidable cylinder.

15. A tool as set forth in claim 1, in which the means for providing fuel consists of a source of pressurized fuel pivotally mounted relative to said housing and metering valve means communicating with the source of pressurized fuel, said metering valve means being operated by a cam means, and trigger control means for effectuating movement of said cam means to meter fuel into said combustion chamber.

16. A tool as set forth in claim 13, in which the means for providing fuel consists of a source of pressurized fuel mounted on a resilient pad and includes a metered flow valve means connected thereto, and means for moving said source of pressurized fuel and operating said metered flow valve to introduce a metered amount of fuel into the combustion chamber including a cap portion that is engaged by the slidable cylinder when the slidable cylinder is moved to its closed position by said bottom trip mechanism.

17. A tool as set forth in claim 1 including a gripping position associated with said housing, switch means on said gripping portion for effecting operation of said fan means whereby turbulence is generated in the combustion chamber upon initial gripping of the tool.

18. A tool as set forth in claim 1, including exhaust valve means located above the bottom of said cylinder for exhausting air beneath the piston as it moves through its driving stroke, the portion of the cylinder below said exhaust valve means, said piston and the housing adjacent the bottom of the cylinder providing a sealed compression chamber whereby the air below the piston and exhaust valve means is compressed to form an air bumper to prevent the piston from contacting the housing adjacent the bottom of the cylinder.

19. A tool as set forth in claim 18, in which the housing section adjacent the bottom of the cylinder includes a plurality of one-way check valves which open to introduce atmospheric air to assist in raising the piston to its driving position after it has been driven and the combustion gases have been exhausted and a negative pressure exists above the piston.

20. A tool as set forth in claim 19, in which the piston is provided with sealing means in contact with the cylinder whereby when the piston returns to its driving position it is retained therein due to the frictional engagement between said sealing means and said cylinder.

21. A tool as set forth in claim 1, including spark plug means in said chamber and piezo-electric means for igniting the spark plug means to ignite the fuel mixture in said combustion chamber.

22. A tool as set forth in claim 21, including trigger means for effecting operation of said piezo-electric means to fire said tool.

23. A portable fastener driving tool comprising: a manually grippable housing, a cylinder in said housing, a piston in said cylinder and movable through a driving stroke from a driving to a driven position, a supply of fasteners associated with said housing, means carried by said piston for driving said fasteners one at a time into a workpiece, means defining a combustion chamber within said housing, said combustion chamber communicating with said cylinder, passage means in said housing for directing air and fuel into said combustion chamber, means associated with said combustion chamber for creating turbulence therein, control means operable in response to gripping of said housing for initiating operation of said means for creating turbulence, means for igniting the air fuel mixture in said combustion chamber to drive said piston from said driving position to said driven position, and means for preventing initiation of operation of said igniting means until said housing has been placed on contact with a workpiece.

24. A tool as set forth in claim 23, including means for sealing said combustion chamber in response to said housing being placed in contact with a workpiece.

25. A tool as set forth in claim 23, wherein said means for creating turbulence includes fan means within said combustion chamber.

26. A tool as set forth in claim 23, wherein said combustion chamber is formed within said housing and is defined in part by one side of said piston.

27. A tool as set forth in claim 23, including normally closed exhaust valve means in said cylinder, said exhaust valve means being opened in response to movement of said piston from said driving position to vent said cylinder.

28. The method of driving a fastener comprising: providing a source of ignitable fuel having a lubricating medium therein, metering a measured amount of said ignitable fuel and lubricant into a combustion chamber, locating a driving member in direct communication with said combustion chamber and in alignment with a fastener to be driven, and igniting said fuel to instantaneously drive said driving member to cause said fastener to engage a workpiece.

29. The method of claim 28 including the step of creating turbulence in said combustion chamber prior to introduction of said fuel therein.

* * * * *